US011060173B2

(12) United States Patent
Somekawa et al.

(10) Patent No.: US 11,060,173 B2
(45) Date of Patent: Jul. 13, 2021

(54) WROUGHT PROCESSED MAGNESIUM-BASED ALLOY AND METHOD FOR PRODUCING SAME

(71) Applicant: NATIONAL INSTITUTE FOR MATERIALS SCIENCE, Ibaraki (JP)

(72) Inventors: Hidetoshi Somekawa, Ibaraki (JP); Alok Shingh, Ibaraki (JP); Tadanobu Inoue, Ibaraki (JP)

(73) Assignee: NATIONAL INSTITUTE FOR MATERIALS SCIENCE, Ibaraki (JP)

( * ) Notice: Subject to any disclaimer, the term of this patent is extended or adjusted under 35 U.S.C. 154(b) by 206 days.

(21) Appl. No.: 16/082,562

(22) PCT Filed: Mar. 8, 2017

(86) PCT No.: PCT/JP2017/009198
§ 371 (c)(1),
(2) Date: Sep. 6, 2018

(87) PCT Pub. No.: WO2017/154969
PCT Pub. Date: Sep. 14, 2017

(65) Prior Publication Data

US 2019/0078186 A1 Mar. 14, 2019

(30) Foreign Application Priority Data

Mar. 10, 2016 (JP) ..... JP2016-046883

(51) Int. Cl.
*C22F 1/06* (2006.01)
*C22C 23/00* (2006.01)

(52) U.S. Cl.
CPC ..... *C22F 1/06* (2013.01); *C22C 23/00* (2013.01)

(58) Field of Classification Search
CPC ..... C22F 1/06; C22C 23/00
(Continued)

(56) References Cited

U.S. PATENT DOCUMENTS 3,119,684 A * 1/1964 Foerster ..... C22C 23/00 148/420
3,119,725 A * 1/1964 Foerster ..... C22C 32/0078 148/538

(Continued)

FOREIGN PATENT DOCUMENTS

CN 105154734 12/2015
JP 2002-371334 12/2002

(Continued)

OTHER PUBLICATIONS

Zhao Y., et al; "Microstructure and Mechanical Properties of Mg—Bi Alloys", Foundry, vol. 61, Issue 7, 2012, p. 758-763 (Year: 2012).*

(Continued)

*Primary Examiner* — Alexandra M Moore
*Assistant Examiner* — Austin Pollock
(74) *Attorney, Agent, or Firm* — Wenderoth, Lind & Ponack, L.L.P.

(57) ABSTRACT

In order to improve the ductility or formability of a magnesium alloy, addition of rare earth elements or refinement of grain size is often used. However, conventional additional elements inhibit the action of grain boundary sliding for complementing plastic deformation. Therefore, it is required to search for additional elements that act to facilitate the grain boundary sliding not only at a conventional deformation speed but also in a higher speed range while maintaining a microstructure for activating non-basal dislocation. The present invention is to provide a wrought processed Mg-based alloy having excellent ductility at room temperature, which consists of 0.25 mass % or more to 9 mass % or less of Bi, and a balance of Mg and inevitable components, and is characterized by having an average grain size of an Mg parent phase after solution treatment and hot plastic working after casting of 20 μm or less.

6 Claims, 11 Drawing Sheets

(58) Field of Classification Search
USPC ..... 148/666–667, 420; 420/402–414
See application file for complete search history.

(56) References Cited

U.S. PATENT DOCUMENTS

| | | | | |
|---|---|---|---|---|
| 2008/0017285 | A1 | 1/2008 | Mukai et al. | |
| 2009/0171452 | A1* | 7/2009 | Yamamoto ..... | A61L 31/148 623/1.38 |
| 2015/0083285 | A1 | 3/2015 | Somekawa et al. | |

FOREIGN PATENT DOCUMENTS

| | | |
|---|---|---|
| JP | 2006-16658 | 1/2006 |
| JP | 2008-214668 | 9/2008 |
| JP | 2010-70839 | 4/2010 |
| JP | 2011-214156 | 10/2011 |
| JP | 2016-17183 | 2/2016 |
| JP | 2016-89228 | 5/2016 |
| WO | 2013/180122 | 12/2013 |

OTHER PUBLICATIONS

Xin H.X., etal; "Electrical and thermoelectric properties of nanocrystal substitutional semiconductor alloys Mg3(BixSb1-x)2 prepared by mechanical alloying", J. of Applied Physics, vol. 39, 2006, p. 5331-5337 (Year: 2006).*

Joshi U., "The grain refinement potency of bismuth in magnesium", J. of Alloys and Compounds, p. 971-975, 2016 (Year: 2016).*

Meng S., et al.; "Microstructure and Mechanical Properties of Extruded Pure Mg with Bi Addition", Acta Metallurgica Sinica, vol. 52, No. 7, p. 811-820 (Year: 2016).*

Meng S., et al.; "Microstructure and Mechanical Properties of Extruded Pure Mg with Bi Addition", Acta Metallurgica Sinica, vol. 52, No. 7, p. 811-820; published Jul. 2016; (w/partial translation from google translate) (Year: 2016).*

Cheng W., et al.; "Corrosion Behavior of as-cast binary Mg—Bi alloys in Hank's solution"; Research and Development China Foundry ; vol. 12, No. 6, 2015 (Year: 2015).*

Office Action dated Sep. 29, 2019 in Chinese Patent Application No. 201780016192.7, with English Language translation.

Notice of Reasons for Refusal dated Mar. 17, 2020 in corresponding Japanese Patent Application No. 2018-504551, with English-language translation.

International Search Report dated Jun. 6, 2017 in International Application No. PCT/JP2017/009198.

J. Koike et al., "The activity of non-basal slip systems and dynamic recovery at room temperature in fine-grained AZ31B magnesium alloys", Acta Materialia, 51 (2003) 2055-2065.

Notice of Reasons for Refusal dated Oct. 1, 2019 in corresponding Japanese Patent Application No. 2018-504551, with English translation.

Office Action dated Apr. 10, 2020 in corresponding Chinese Patent Application No. 201780016192.7 with English-language translation.

Notification of Reasons for Refusal dated Jun. 30, 2020 in corresponding Japanese Patent Application No. 2018-504551, with English-language translation.

* cited by examiner

WROUGHT PROCESSED MAGNESIUM-BASED ALLOY AND METHOD FOR PRODUCING SAME

TECHNICAL FIELD

The present invention relates to a wrought processed magnesium (Mg)-based alloy, and a method for producing the wrought processed Mg-based alloy. More specifically, the present invention relates to a wrought processed Mg-based alloy of fine grains, which is added by bismuth (Bi) and excellent in ductility at room temperature, and to a method for producing the wrought processed Mg-based alloy.

BACKGROUND ART

An Mg alloy is attracting attention as a next-generation lightweight metal material. However, an Mg metal crystal structure is a hexagonal crystal structure, therefore, the difference of critical resolved shear stress (CRSS) between the basal slip and the non-basal slip, i.e., the prismatic slip, is extremely large in the vicinity of room temperature. Accordingly, the Mg alloy has poor ductility as compared with other wrought processed metal materials of aluminum (Al), iron (Fe) or the like, therefore, the plastic deformation processing at room temperature is difficult.

In order to solve the problem described above, alloying by the addition of rare earth elements is frequently used. For example, in Patent Literatures 1 and 2, the plastic deformability has been improved by the addition of rare earth elements including yttrium (Y), cerium (Ce), and lanthanum (La). This is because the rare earth elements have a function of reducing the CRSS on non-basal, that is, a function of narrowing the gap of CRSS between the basal and the non-basal and facilitating the dislocation slip motion of non-basal. However, with the use of the rare earth elements, the material price increases, therefore, from the economic point of view, it is required to improve the ductility and formability by the addition of cheaper conventional elements.

On the other hand, in the vicinity of the grain boundary of Mg, it has also been pointed out that complicated stress necessary for continuing the deformation, that is, grain boundary compatibility stress acts and the non-basal slip is activated (Non Patent Literature 1). Therefore, it has been proposed that introducing a large amount of grain boundaries (grain refinement) is effective for improving the ductility.

In Patent Literature 3, a fine grain Mg alloy in which one kind of elements selected from the group consisting of Ca, Sr, Ba, Sc, Y, La, Ce, Pr, Nd, Pm, Sm, Eu, Gd, Tb, Dy, Ho, Dr, Tm, Yb, and Lu, each of which is a rare earth element or a general-purpose element, are contained in a minute amount; the grains are refined; and the strength properties are excellent has been disclosed. It is said that the increase in strength of this alloy is mainly attributed to segregation of these solute elements at grain boundaries. On the other hand, in the fine grain Mg alloy, the dislocation slip of non-basal is activated by the action of grain boundary compatibility stress.

However, with regard to the grain boundary sliding that functions to complement the plastic deformation, in these alloys, any one of the additive elements also has a function of suppressing the development of grain boundary sliding, therefore, the grain boundary sliding substantially does not contribute to deformation. Accordingly, the ductility of these alloys at room temperature is required to be further improved at the same level as that of a conventional Mg alloy. That is, it is required to search for a solute element that does not suppress the development of grain boundary sliding while maintaining the microstructure on which grain boundary compatibility stress acts.

So far, the inventors have disclosed an Mg alloy containing 0.07 to 2 mass % of Mn and having excellent ductility at room temperature (Patent Literature 4). Further, as a result of further conducting the study, it has been found that an Mg alloy that is excellent in ductility at room temperature can be obtained, even if Zr is contained in place of the Mn (Patent Literature 5). These alloys are characterized in that the average grain size is 10 μm or less, the elongation-to-failure is around 150%, and the m value being an index of the contribution of grain boundary sliding to deformation is 0.1 or more. In addition, these alloys are characterized by using a stress reduction degree as an index of formability, and the value is 0.3 or more. However, depending on the formed part at the time of secondary forming, there may be a case where larger ductility and formability are required, therefore, it is necessary to further search for a solute element that exhibits more excellent characteristics than those of an Mg—Mn alloy or an Mg—Zr alloy.

In addition, from the viewpoint of the productivity, development of an Mg-based alloy that is excellent in ductility at room temperature and the formability in a faster deformation speed range has been desired. In general, in the periodic table, elements belonging to homologous elements (columns of the periodic table) or both of the sides (rows of the periodic table) often show the same characteristics and effects. Accordingly, although the development of an Mg-based alloy to which a proximity element of Mn or Zr in the periodic table was added has been conducted, there has been still no disclosure about the additional element exhibiting an effect exceeding that of Mn or Zr.

CITATION LIST

Patent Literature

Patent Literature 1: WO 2013/180122
Patent Literature 2: JP 2008-214668 A
Patent Literature 3: JP 2006-16658 A
Patent Literature 4: JP 2016-17183 A
Patent Literature 5: JP 2016-089228 A
Patent Literature 6: JP 2011-214156 A

Non Patent Literature

Non Patent Literature 1: J. Koike et al., Acta Mater, 51 (2003) p 2055

SUMMARY OF INVENTION

Technical Problem

In view of the above circumstances, an object of the present invention is to provide a wrought processed Mg-based alloy, which is an Mg-based alloy in which a solute element that does not suppress the development of grain boundary sliding is added while maintaining the microstructure on which grain boundary compatibility stress acts, has excellent ductility at room temperature and secondary workability, and further is economically excellent as compared with a conventional Mg-based alloy to which a rare earth element or a general-purpose element is added.

Solution to Problem

As a result of the intensive study to solve the problem described above, the present inventors have found an idea of using Bi that has a large solid solution amount to Mg and has a low melting point, as a solute element. Moreover, the present inventors have found that by controlling the average grain size in a wrought processed Mg-based alloy to which Bi has been added alone, an effect that is at least equivalent to the effect of an Mg-based alloy to which Mn or Zr has been added alone and which has been proposed by the present inventors so far, can be obtained, and thus have completed the present invention.

It has been disclosed that Bi can be used as a solute element of an Mg-based alloy, for example, in Patent Literature 6. Specifically, in Patent Literature 6, Bi is mentioned as one of the additional elements to be added to Mg that is a base material of an Mg alloy sheet material, and it is described that the amount be added is 0.001 to 5 mass %. Herein, the Mg alloy sheet material of Patent Literature 6 is produced by positively imparting distortion to a rolled material, and it is said that heat treatment for the purpose of recrystallization is not performed before and after the step of imparting the distortion. In addition, in the Mg alloy sheet material produced in this way, a processing distortion as a starting point of breakdown, that is, a shear band remains, therefore, a clear grain boundary is hardly observed even if the inside is observed by a microscope, and the grain has an unclear structure. Accordingly, it is said that in this Mg alloy sheet material, the measurement of the grain size and the measurement of the orientation of each grain cannot be substantially conducted or are difficult to be conducted. That is, it is difficult to control the average grain size of the microstructure, therefore, it is considered that the activation of grain boundary sliding and the improvement of ductility at room temperature cannot be substantially performed. In addition, in a case where the heat treatment for the purpose of recrystallization is not performed as described above, the shear band as a starting point of breakdown remains, therefore, it is extremely difficult to obtain excellent formability at room temperature enough to satisfy the required characteristics of various applications of the Mg-based alloy.

That is, the present invention is characterized by the following.

A first aspect of the present invention is to provide a wrought processed Mg-based alloy having excellent ductility at room temperature, consisting of 0.25 mass % or more to 9 mass % or less of Bi, and a balance of Mg and inevitable components, in which an average grain size of an Mg parent phase after solution treatment and hot plastic working after casting is 20 μm or less.

A second aspect of the present invention is to provide the wrought processed Mg-based alloy described in the first aspect of the present invention, in which in at least one of the Mg parent phase and a grain boundary in a metal structure of the wrought processed Mg-based alloy, Mg—Bi intermetallic compound particles having a particle diameter of 0.5 μm or less are precipitated while mutually dispersing.

A third aspect of the present invention is to provide the wrought processed Mg-based alloy described in the first or second aspect of the present invention, in which a strain rate sensitivity exponent (m value) in a tensile test at room temperature or a compression test of the wrought processed Mg-based alloy shows 0.1 or more.

A fourth aspect of the present invention is to provide the wrought processed Mg-based alloy described in any one of the first to third aspects of the present invention, in which in a stress-strain curve obtained by a compression test of the wrought processed Mg-based alloy at room temperature, work hardening is not exhibited when a compressive strain is 0.2, a plateau region being in a state of constant stress exists, and breaking state is not generated.

A fifth aspect of the present invention is to provide the wrought processed Mg-based alloy described in any one of the first to fourth aspects of the present invention, in which a value of deformation anisotropy obtained by the tensile test at room temperature or the compression test of the wrought processed Mg-based alloy is 0.8 or more, and the wrought processed Mg-based alloy is capable of being deformed in an isotropic manner in three dimensions.

A sixth aspect of the present invention is to provide the wrought processed Mg-based alloy described in any one of the first to fifth aspects of the present invention, in which in an internal friction test by a nanoscale dynamic mechanical analysis method, a value of tan δ at a frequency of 0.1 Hz is 1.2 times or more as compared with that of a pure magnesium material.

A seventh aspect of the present invention is to provide a method for producing the wrought processed Mg-based alloy described in any one of the first to sixth aspects of the present invention, in which an Mg-based alloy casting material passed through steps of melting and casting is subjected to solution treatment at a temperature of 400° C. or more to 650° C. or less for 0.5 hour or more to 48 hours or less, and then subjected to hot plastic working at a temperature of 50° C. or more to 550° C. or less and a cross section reduction rate of 70% or more.

An eighth aspect of the present invention is to provide the method for producing the wrought processed Mg-based alloy described in the seventh aspect of the present invention, in which the hot plastic working is any one of an extrusion processing, a forging processing, a rolling processing, and a drawing processing.

DESCRIPTION OF EMBODIMENTS

The content of Bi in an Mg-based alloy material for obtaining the effect of the present invention is 0.25 mass % or more to 9 mass % or less. The content of Bi of 0.25 mass % (=0.03 mol %) means the minimum amount to be added, with which the Bi being a solute element affects the deformation behavior. That is, in a case where the content is 0.25 mass %, it can be estimated that the Bi atoms dissolved as a solid solution mutually exist in an Mg crystal at intervals of $19.5\times10^{-4}$ μm. The distance corresponds to around three times the Burgers vector of Mg, and means a limit value at which lattice defects of dislocation or the like interact with each other in atomic bonding theory. On the other hand, in a case where the content of Bi exceeds 9 mass %, the maximum solid solution amount of Bi in the Mg crystal is exceeded, therefore, a coarse intermetallic compound including Mg—Bi is dispersed in the grains and in the grain boundaries. The dispersion of these coarse intermetallic compound particles becomes origin of breakdown during plastic deformation, and it cannot be said that this is preferable from the viewpoint of improving the ductility. Herein, the size of an Mg—Bi intermetallic compound particle is preferably 0.5 μm or less, and more preferably 0.1 μm or less.

In the wrought processed Mg-based alloy according to the present invention, the average grain size of the Mg parent phase after hot plastic working is preferably 20 μm or less. The average grain size is more preferably 10 μm or less, and furthermore preferably 5 μm or less. In a case where the grain size is coarser than 20 μm, the grain boundary compatibility stress generated in the vicinity of grain boundaries does not affect the whole area in grains. That is, it is difficult that the non-basal dislocation slip acts in the whole area in grains, and the ductility is not expected to be improved. Of course, if the average grain size is 20 μm or less, an Mg—Bi intermetallic compound having a size of 0.5 μm or less may be dispersed in the Mg grains and grain boundaries. In addition, as coarse as the average grain size can be maintained to be 20 μm or less, heat treatment such as strain relief annealing may be performed after hot plastic working. In this regard, the Bi element may be segregated or not be segregated at grain boundaries.

Next, a production method of obtaining a microstructure will be described. A smelted Mg—Bi alloy casting material is subjected to solution treatment at a temperature of 400° C. or more to 650° C. or less. Herein, in a case where the solution treatment temperature is less than 400° C., in order to homogeneously dissolve Bi as a solid solution, it is required to retain the temperature for a long period of time, and this is not preferred from an industrial point of view. On the other hand, when the temperature exceeds 650° C., because of being the solid phase temperature or more, the local melting starts, and it becomes dangerous in the operation. In addition, the solution treatment time is preferably 0.5 hour to 48 hours. In a case where the solution treatment time is less than 0.5 hour, the diffusion of solute elements throughout the parent phase becomes insufficient, therefore, the segregation during casting remains, and a sound material cannot be created. In a case where it exceeds 48 hours, the operation time becomes long, and this is not preferred from an industrial point of view. Of course, as the casting method, any method can be adopted as long as it can produce the Mg-based alloy casting material of the present invention, such as gravity casting, sand mold casting, die casting or the like.

After the solution treatment, hot plastic working is performed. The temperature for hot plastic working is preferably 50° C. or more to 550° C. or less. In a case where the processing temperature is less than 50° C., because the processing temperature is low, dynamic recrystallization is hardly generated, and a sound wrought processed material can be prepared. In a case where the processing temperature exceeds 550° C., recrystallization progresses during the processing, grain refinement is inhibited, and further this causes a reduction in the life of the mold in extrusion processing.

For the strain application during hot plastic working, the total cross sectional reduction rate is 70% or more, preferably 80% or more, and more preferably 90% or more. In a case where the total cross sectional reduction rate is less than 70%, the strain application is not sufficient, therefore, the grain size cannot be refined. In addition, it is considered that an intermetallic compound including Mg—Bi is generated in the parent phase and in the grain boundaries before the strain application, that is, during the holding in a furnace or container heated to a predetermined temperature. In such a case, it is difficult to finely disperse these intermetallic compounds unless sufficient strain is applied. Representative examples of the hot plastic working method include extrusion, forging, rolling, and drawing, and any working method can be adopted as long as it is a plastic working method by which strain can be applied. However, only by performing the solution treatment to the casting material without performing the hot plastic working, the grain size of the Mg parent phase is coarse, therefore, the effect of the present invention cannot be obtained because.

An index for evaluating the ductility and formability of the wrought processed Mg-based alloy at room temperature, that is, the stress reduction degree and the strain rate sensitivity exponent (m value) will be described. Both of the indexes can be calculated from the nominal stress and nominal strain curve obtained by a tensile test.

The stress reduction degree can be determined by the following formula (1), and the value of the stress reduction degree is preferably 0.3 or more, and more preferably 0.4 or more.

[Mathematical Formula 1]

$$(\sigma max - \sigma_{bk})/\sigma_{max} \qquad \text{Formula (1)}$$

In this regard, σmax is the maximum stress, and σbk is stress at break, and an example of which is shown in FIG. 4.

In addition, the presence or absence of grain boundary sliding along with deformation can be predicted by using an m value.

The m value has the relationship of the following formula (2):

[Mathematical formula 2]

$$\dot{\varepsilon} = A\sigma^{m} \qquad \text{Formula (2)}$$

and

[Mathematical formula 3]

$$\dot{\varepsilon}$$

is a strain rate, A is a constant, and σ is a flow stress. The larger the m value is, the greater the development of grain boundary sliding is and the greater the contribution to deformation is. Under room temperature plastic deformation conditions of a common Mg alloy, dislocation motion is responsible for the total deformation, therefore, the m value is 0.05 or less. Accordingly, in order to obtain the effect of the invention, that is, in order to perform the contribution of grain boundary sliding to the deformation, the m value is preferably 0.1 or more, and more preferably 0.15 or more.

Characteristics of the stress-strain curve of a common wrought processed Mg-based alloy, which is obtained by a compression test at room temperature, will be described. In FIG. 1, a nominal stress-nominal strain curve obtained by a compression test of a typical extruded Mg-3 mass % Al-1 mass % Zn alloy at room temperature is shown. Although a yielding behavior is shown, it can be confirmed that a rapid stress increase, that is, work hardening occurs with the strain application. This work hardening is because twin crystals are formed during deformation and dislocations accumulate at the interface of these twin crystals. On the other hand, the twin crystal interface is energetically unstable, which is different from a common grain boundary, therefore, in a case where dislocations accumulate excessively at the twin crystal interface, the twin crystal interface becomes a starting point of breakdown, that is, a starting point of crack formation. Accordingly, it is difficult to apply compressive strain of 20% or more. In order to improve the compressive deformability, it is required to suppress the formation of twin crystals and to develop the grain boundary sliding.

Plastic deformation of a common wrought processed Mg-based alloy is dislocation motion and deformed twin as described above. However, the CRSS of both of the deformation mechanisms are greatly different, and the CRSS of the deformed twin is around half of the dislocation motion. In addition, these deformation mechanisms is influenced by the stress application direction, and the dislocation motion preferentially acts in the tensile stress field, and the deformed twin preferentially acts in the compressive stress field. Therefore, in a common wrought processed Mg-based alloy, the deformation mechanism varies due to the stress application direction, and the deformation anisotropy is generated, that is, there is a problem that the deformation cannot be generated in an isotropic manner. On the other hand, the grain boundary sliding is a sliding motion between grains, therefore, isotropic deformation in three dimensions is possible without being affected by the stress application direction. Herein, as an index for identifying the deformation anisotropy of the Mg-based alloy, the following formula (3) is defined:

$$\text{(Deformation anisotropy)}=\text{(Compression yield stress)}\div\text{(Tensile yield stress)} \quad \text{Formula (3)}$$

The value of the deformation anisotropy of a common wrought processed Mg-based alloy is 0.5 to 0.6. In this regard, each yield stress is a value obtained by a tensile test and a compression test, and flow stress may be used.

In addition, by the action of grain boundary sliding, the improvement of internal friction characteristics can be expected. In a case where minute strain by which plastic deformation is not generated is applied, generally, the applied internal energy is reduced by the extension and contraction motion of a dislocation. Accordingly, when solid solution elements are present in a parent phase, the above-described dislocation motion is inhibited, therefore, the internal energy cannot be released efficiently. That is, it is well known that a pure metal is excellent in the internal friction characteristics, in which solid solution elements are present in a less amount in the parent phase as compared with various kinds of alloy materials. On the other hand, even in the "grain boundary sliding" in which sliding between grain boundaries acts irrespective of dislocation motion, there is also a function of reducing the internal energy. Accordingly, in a case where the m value obtained by the above formula (2) is large, it is suggested that the internal friction characteristics are excellent. In addition, as an index of the internal friction characteristics, for example, a dynamic viscoelasticity (nanoscale dynamic mechanical analysis) method that is one of the nano indentation methods may be used. In this case, the value of tan δ to the measurement frequency varies depending on the composition or production conditions of the wrought processed Mg-based alloy, the test conditions, or the like, and in the wrought processed Mg-based alloy according to the present invention, the value of tan δ preferably shows a value of 1.2 times or more, more preferably 1.4 times or more, and furthermore preferably 1.5 times or more at a predetermined frequency as compared with a pure magnesium material having an average grain size almost the same as that of the wrought processed Mg-based alloy.

EXAMPLES

For commercially available pure Bi (99.9 mass %) and commercially available pure Mg (99.98 mass %), Bi and Mg were adjusted by using an iron crucible so that the target contents of Bi were 0.42 mass %, 2.50 mass %, 4.55 mass %, and 7.80 mass %, respectively, and the four types of Mg—Bi alloy casting materials were melted by using an iron crucible. In this regard, casting was performed by using an iron mold having a diameter of 50 mm and a height of 200 mm and by setting the melting temperature to 700° C. and the melting retention time to 5 minutes under an Ar atmosphere. After subjecting the casting material to solution treatment at 500° C. for 2 hours, the element concentrations of the Bi and the inevitable components were analyzed and evaluated by ICP emission spectroscopy. The results of the analysis are shown in Table 1.

TABLE 1

| Casting material No. | | Bi | Fe | Si | Ni | Mn |
|---|---|---|---|---|---|---|
| 1 | Mg—0.42Bi | 0.42 (=0.05) | 0.002 | 0.003 | <0.001 | 0.004 |
| 2 | Mg—2.5Bi | 2.5 (=0.30) | 0.004 | 0.002 | <0.001 | 0.003 |
| 3 | Mg—4.55Bi | 4.55 (=0.60) | 0.002 | 0.005 | <0.001 | 0.002 |
| 4 | Mg—7.80Bi | 7.80 (=1.0) | 0.001 | 0.005 | <0.001 | 0.002 |

The value described inside of the parentheses is mol %, and the other is mass %.

Casting materials 1 to 4 after the solution treatment were processed into cylindrical extrusion billets each having a diameter of 40 mm and a length of 60 mm by machining. The processed billets were held for 30 minutes in a container set at 110 to 140° C., and then subjected to hot plastic working by extrusion at an extrusion ratio of 25:1 (=area reduction ratio: 94%), and extruded materials each having a shape of a diameter of 8 mm and a length of 500 mm or more were prepared (hereinafter, referred to as extruded alloys). In addition, in order to prepare Mg—Bi alloys having different grain sizes of Mg parent phases, the respective extruded Mg—Bi alloys were held in a muffle furnace set at 200 to 350° C. within a range of 24 hours or less to perform heat treatment.

TABLE 2

| | | Extrusion temperature [° C.] | Heat treatment Temperature [° C.] | Heat treatment Time [hrs] | Average grain size [μm] |
|---|---|---|---|---|---|
| Example 1 | Mg-0.42Bi | 110 | None | None | 2.5 |
| Example 2 | Mg-2.5Bi | 110 | None | None | 0.9 |
| Example 3 | Mg-2.5Bi | 140 | None | None | 3 |
| Example 4 | Mg-2.5Bi | 110 | 200 | 1 | 9.8 |
| Example 5 | Mg-4.55Bi | 110 | None | None | 2 |
| Example 6 | Mg-4.55Bi | 110 | 200 | 1 | 8 |
| Example 9 | Mg-4.55Bi | 110 | 350 | 1 | 13 |
| Example 7 | Mg-7.8Bi | 110 | None | None | 1.8 |
| Example 8 | Mg-7.8Bi | 110 | 250 | 1 | 8 |
| Example 10 | Mg-7.8Bi | 110 | 350 | 4 | 13 |
| Comparative Example 1 | Mg-2.5Bi | 140 | 350 | 3 | 21 |
| Comparative Example 2 | Mg-4.55Bi | 110 | 350 | 2 | 21 |
| Comparative Example 3 | Mg-7.8Bi | 110 | 350 | 6 | 21 |

Figure 2:
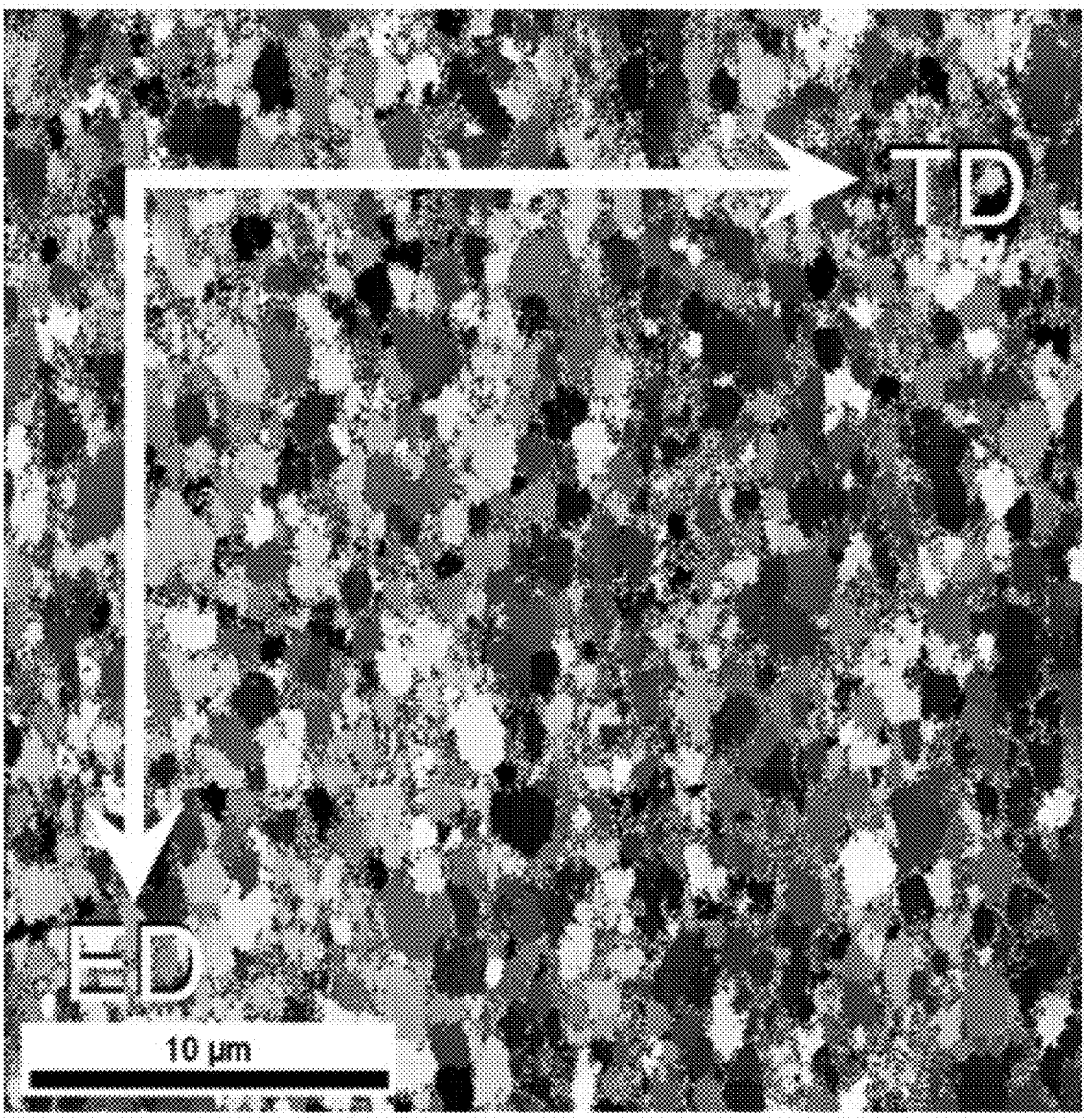
FIG. 2 shows a photograph of a microstructure of an extruded Mg—Bi alloy of Example 2 observed by a scanning electron microscope/electron back scattering diffraction.
Figure 3:
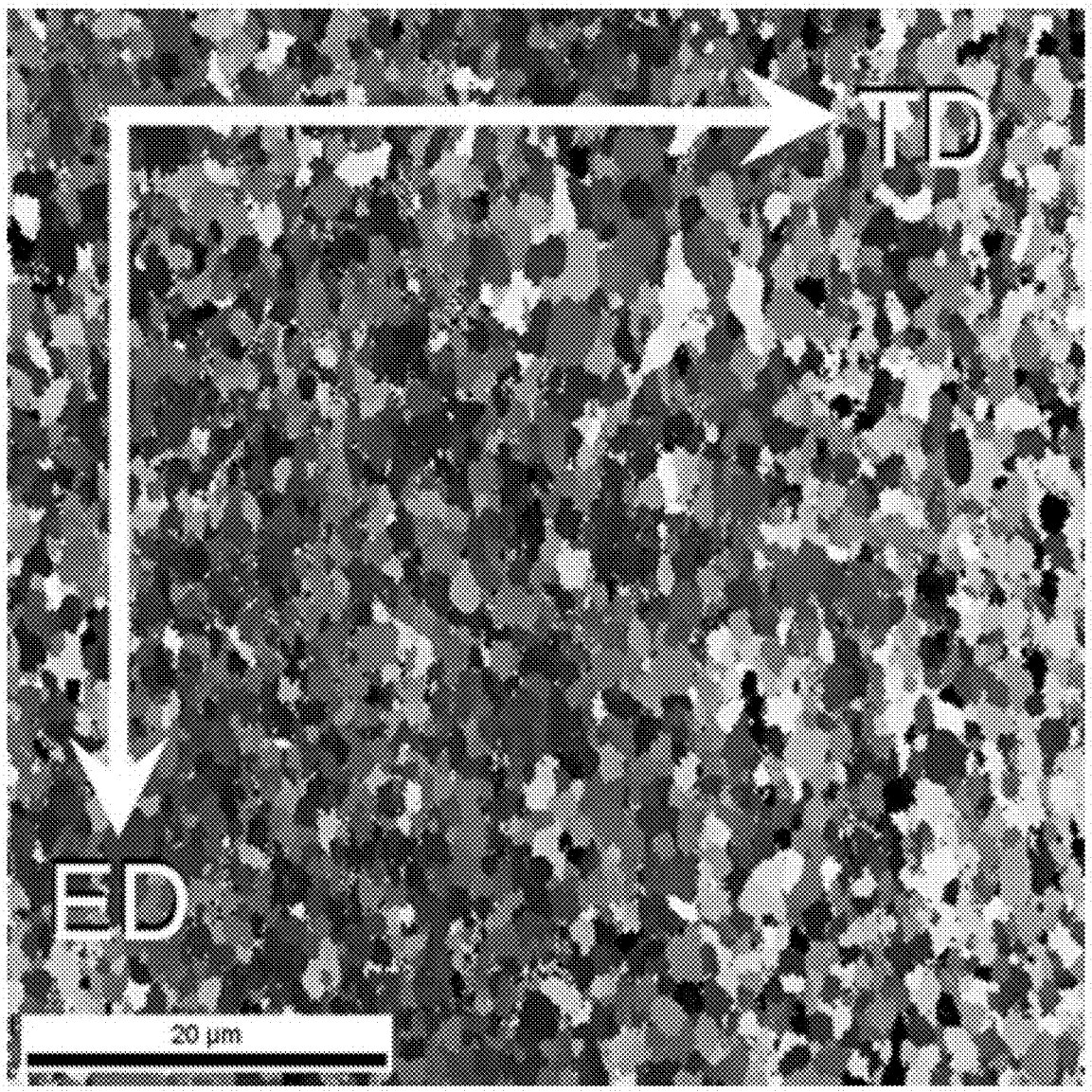
FIG. 3 shows a photograph of a microstructure of an extruded Mg—Bi alloy of Example 3 observed by a scanning electron microscope/electron back scattering diffraction.

By using an optical microscope, and a scanning electron microscope/electron back scattering diffraction method, the microstructure observation of the prepared Mg—Bi alloy by extrusion was performed. Examples of the observed typical microstructure (the extruded Mg-2.5 mass % Bi alloys of Examples 2 and 3, respectively) are shown in FIGS. 2 and 3. In both of the drawings, the area having the same contrast is one grain, and it can be understood that the average grain size of the extruded Mg-2.5 mass % Bi alloys is 20 μm or less even at different extrusion temperatures. In addition, also in any of the extruded Mg—Bi alloy, it was confirmed from the observation results of microstructures by using a transmission electron microscope that the Mg—Bi intermetallic compound particles having a particle diameter of 0.5 μm or less are precipitated while mutually dispersing in an Mg parent phase of the metal structure. In this regard, the average grain size of each of the Mg—Bi alloys was determined by a section method and summarized in Table 2. Herein, in order to obtain the effect of the present invention, it is important that the average grain size of the Mg—Bi alloy is 20 μm or less.

<Test Result 1>

[Tensile Test at Room Temperature]

Figure 4:
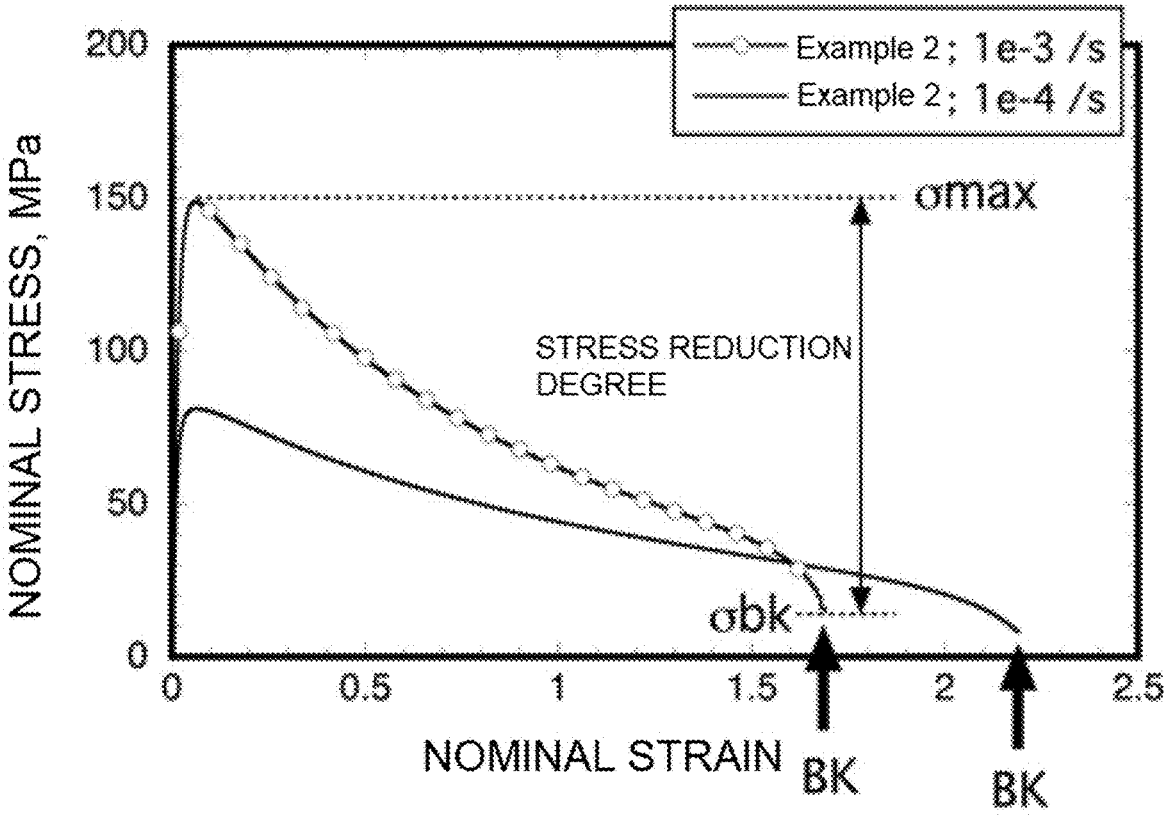
FIG. 4 shows a nominal stress-nominal strain curve obtained by a tensile test of an extruded Mg—Bi alloy of Example 2 at room temperature.

For a test piece collected from an extruded alloy, a tensile test was conducted at room temperature by setting the initial strain rate within the range of $1\times10^{-2}$ $s^{-1}$ to $1\times10^{-5}$ $s^{-1}$. In a tensile test, a round bar test piece having a parallel part length of 10 mm and a parallel part diameter of 2.5 mm was used in accordance with the JIS standard. All of the test pieces were taken from a direction parallel to the extrusion direction. In FIG. 4, a nominal stress-nominal strain curve obtained by the tensile test at room temperature is shown. It can be confirmed that the extruded Mg—Bi alloy of Example 2 had an elongation-to-failure of 165% and exhibited extremely excellent ductility even at a strain rate of $1\times10^{-3}$ $s^{-1}$. Herein, the case where the stress rapidly decreased (20% in each measurement) is defined as a state of "breaking" (indicated as BK in the drawing), and the nominal strain at that time is summarized in Table 3 as elongation-to-failure.

TABLE 3

| | | Average grain size [μm] | $1\times10^{-2}$, [1/s] | $1\times10^{-3}$, [1/s] | $1\times10^{-4}$, [1/s] | $1\times10^{-5}$, [1/s] | m Value From $1\times10^{-2}$ to $1\times10^{-3}$ | m Value From $1\times10^{-3}$ to $1\times10^{-4}$ | m Value From $1\times10^{-4}$ to $1\times10^{-5}$ |
|---|---|---|---|---|---|---|---|---|---|
| | | | Elongation-to-failure [%] / Stress reduction degree | | | | | | |
| Example 1 | Mg—0.42Bi | 2.5 | 27 | 57 | 158 | Unmeasured | 0.1 | 0.18 | — |
| | | | 0.17 | 0.41 | 0.83 | Unmeasured | | | |
| Example 2 | Mg—2.5Bi | 0.9 | 50 | 165 | 220 | 420 | 0.15 | 0.26 | 0.28 |
| | | | 0.4 | 4.76 | 0.81 | 0.86 | | | |
| Example 3 | Mg—2.5Bi | 3 | 33 | 65 | 155 | 340 | 0.1 | 0.21 | 0.27 |
| | | | 0.21 | 0.55 | 0.92 | 0.8 | | | |
| Example 4 | Mg—2.5Bi | 9.8 | Unmeasured | 36 | 48 | Unmeasured | — | 0.18 | — |
| | | | Unmeasured | 0.3 | 0.45 | Unmeasured | | | |
| Example 5 | Mg—4.55Bi | 2 | 40 | 65 | 122 | 212 | 0.11 | 0.18 | 0.25 |
| | | | 0.3 | 0.52 | 0.66 | 0.73 | | | |
| Example 6 | Mg—4.55Bi | 8 | Unmeasured | 31 | 43 | 57 | — | 0.1 | 0.14 |
| | | | Unmeasured | 0.21 | 0.24 | 0.66 | | | |
| Example 9 | Mg—4.55Bi | 13 | Unmeasured | Unmeasured | 20 | 25 | — | — | 0.1 |
| | | | Unmeasured | Unmeasured | 0.17 | 0.18 | | | |
| Example 7 | Mg—7.8Bi | 1.7 | 40 | 64 | 155 | 188 | 0.11 | 0.17 | 0.22 |
| | | | 0.3 | 0.52 | 0.65 | 0.71 | | | |
| Example 8 | Mg—7.8Bi | 8 | Unmeasured | Unmeasured | 26 | 44 | — | — | 0.12 |
| | | | Unmeasured | Unmeasured | 0.24 | 0.32 | | | |
| Example 10 | Mg—7.8Bi | 13 | Unmeasured | Unmeasured | 21 | 29 | — | — | 0.1 |
| | | | Unmeasured | Unmeasured | 0.17 | 0.2 | | | |
| Comparative Example 1 | Mg—2.5Bi | 21 | Unmeasured | <10 | <10 | Unmeasured | — | <0.1 | — |
| | | | Unmeasured | <0.05 | <0.05 | Unmeasured | | | |
| Comparative Example 2 | Mg—4.55Bi | 21 | Unmeasured | Unmeasured | <10 | <10 | — | — | <0.1 |
| | | | Unmeasured | Unmeasured | <0.05 | <0.1 | | | |
| Comparative Example 3 | Mg—7.8Bi | 21 | Unmeasured | Unmeasured | <10 | <10 | — | — | <0.1 |
| | | | Unmeasured | Unmeasured | <0.05 | <0.1 | | | |

$1\times10^{-2}$, [1/s]: It means a strain rate of $1\times10^{-2}$ [1/s]
$1\times10^{-3}$, [1/s]: It means a strain rate of $1\times10^{-3}$ [1/s]
$1\times10^{-4}$, [1/s]: It means a strain rate of $1\times10^{-4}$ [1/s]
$1\times10^{-5}$, [1/s]: It means a strain rate of $1\times10^{-5}$ [1/s]

Further, it can be understood that the nominal stress and nominal strain curve of the extruded Mg—Bi alloy of Example 2, which is shown in FIG. 4, indicates a large stress reduction degree after the maximum stress. For example, in the extruded Mg—Bi alloy of Example 2, in a case where a test is performed at a strain rate of $1\times10^{-3}$ $s^{-1}$, the value of $(\sigma max-\sigma k)/\sigma max$ is 0.76, therefore, it is suggested that the plastic deformation limit of the alloy of the present invention is large, and the formability is excellent.

Figure 5:
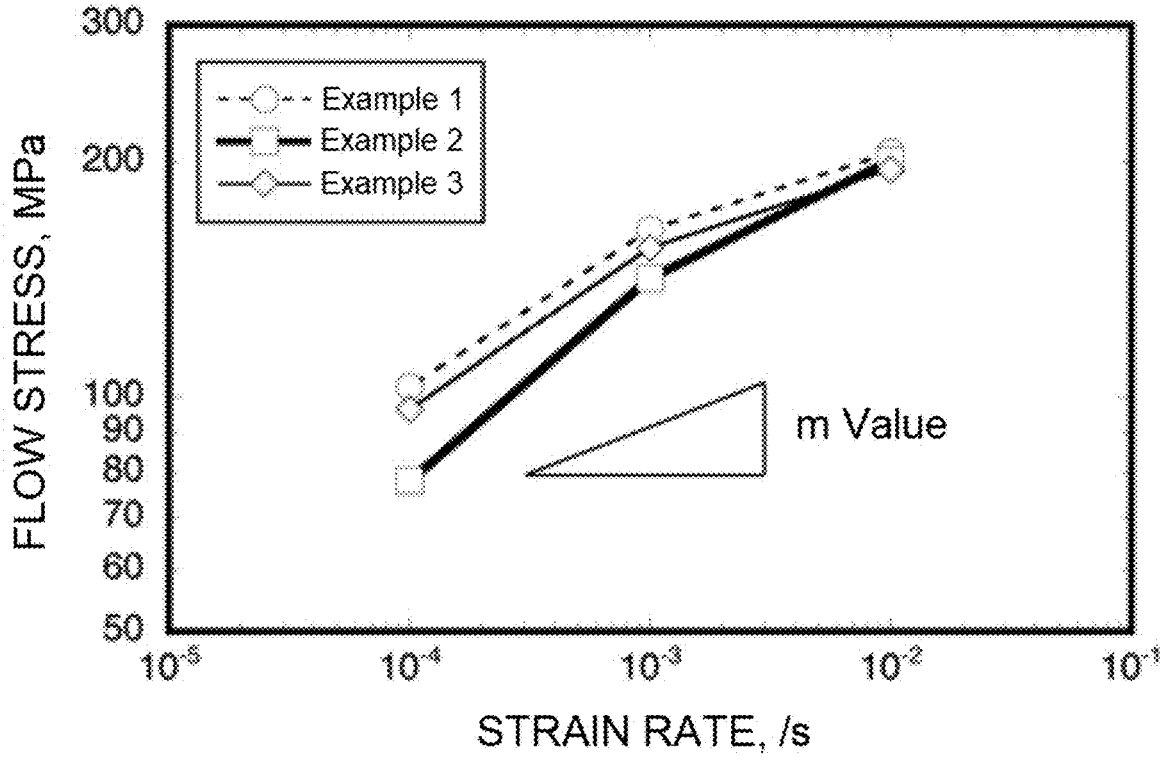
FIG. 5 shows a graph indicating a relationship between the flow stress and the strain rate of an extruded Mg—Bi alloy of each of Examples 1 to 3.

On the basis of the results of respective tensile tests, for the extruded Mg—Bi alloys of Examples 1 to 3, the value of the nominal stress at a nominal strain of 0.1 is taken as the flow stress, and the relationship between the flow stress and the strain rate is shown in FIG. 5. In FIG. 5, the slope of a straight line corresponds to the m value, the strain rates at which the tensile tests were performed are divided, and the values determined by a mean-square method are shown in Table 3. The m values of the Mg—Bi alloy of Examples each indicate 0.1 or more, and due to the development of grain boundary sliding, high ductility is generated at room temperature.

Figure 6:
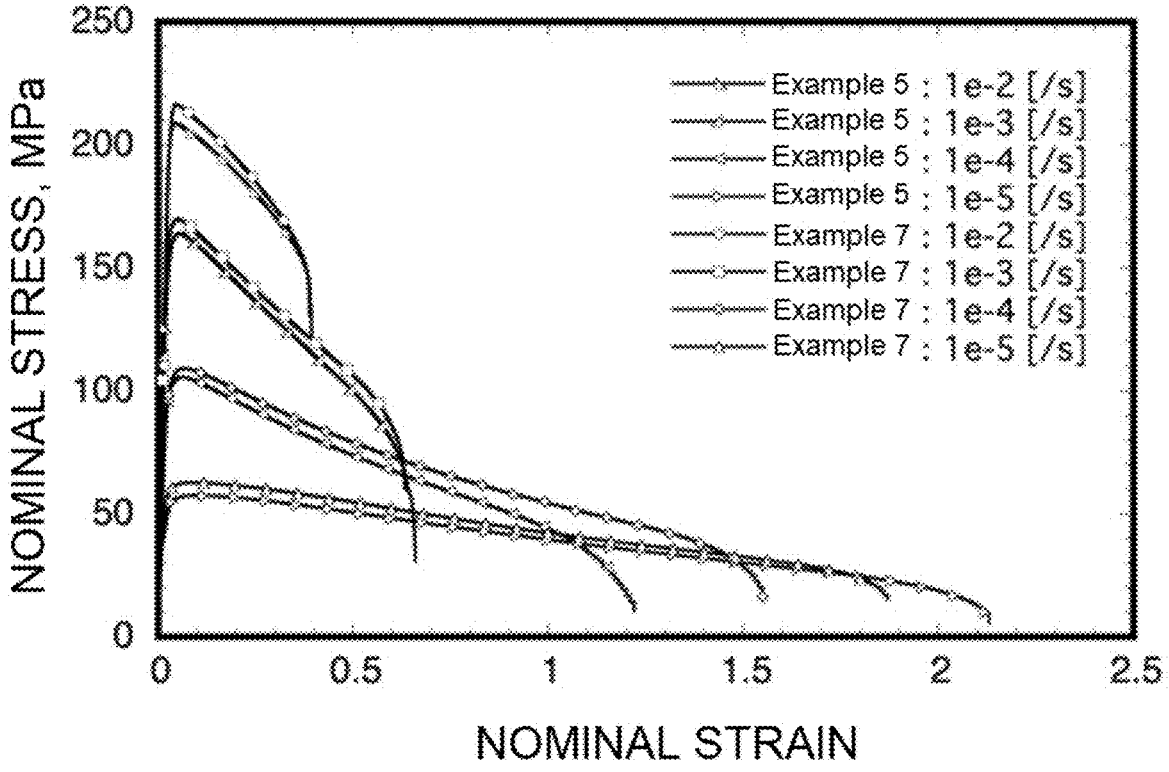
FIG. 6 shows a nominal stress-nominal strain curve obtained by a tensile test of an extruded Mg—Bi alloy of each of Examples 5 and 7 at room temperature.

In order to examine the effect of the amount of the Bi to be added, the nominal stress-nominal strain curve obtained by a tensile test using each of the extruded Mg—Bi alloys of Examples 5 and 7 is shown in FIG. 6. As with the extruded Mg-2.5 mass % Bi alloy of Example 2 shown in FIG. 4, it can be confirmed that a large elongation-to-failure and a large stress reduction degree are exhibited irrespective of the amount of the Bi to be added. In addition, the nominal stress of each of the extruded Mg—Bi alloys of Examples 5 and 7 greatly depends on the strain rate, and it is suggested that both of the extruded alloys have large m values. In this regard, the elongation-to-failure, the stress reduction degree, and the m value of each of the extruded alloys, which have been obtained by a tensile test, are summarized in Table 3.

[Comparison Test]

Figure 7:
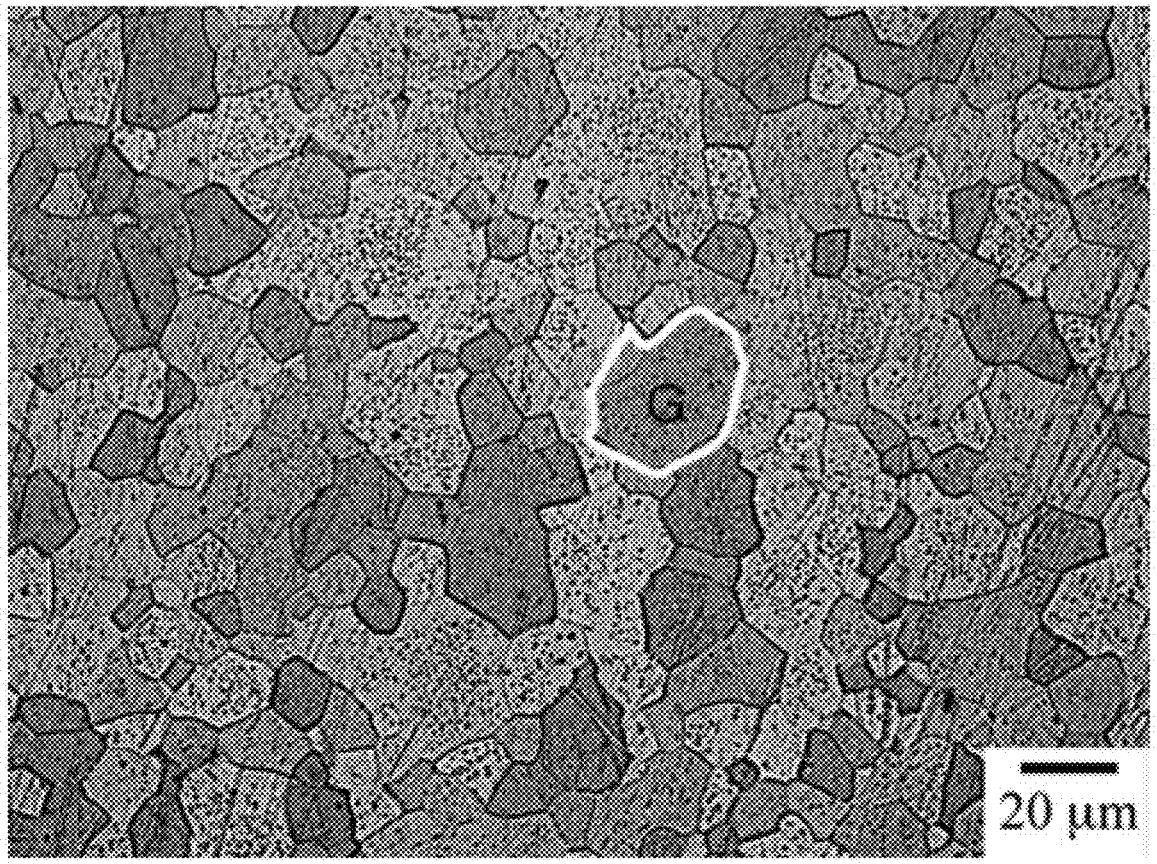
FIG. 7 shows a photograph of a microstructure of an Mg—Bi alloy of Comparative Example 1 observed by an optical microscope.

By using an extruded Mg—Bi alloy having a composition similar to those in Examples 3, 5 and 7, heat treatment was performed in a muffle furnace to prepare samples having an average grain size of larger than 20 μm, and the prepared samples were taken as samples to be used in Comparative Examples 1 to 3, respectively. The microstructural observation of the Mg—Bi alloys of Comparative Examples 1 to 3 was performed. In FIG. 7, an example of the typical structure of the Mg-2.5 mass % Bi alloy of Comparative Example 1 is shown. The area surrounded by a white line was one grain, and the average grain size calculated by a section method was 21 μm. By using the samples having an average grain size of larger than 20 μm, and a tensile test was conducted at room temperature under the same test piece shape and test conditions as in Examples. The obtained results are summarized in Table 3. it can be understood that both of the elongation-to-failure and the m value are decreased in Comparative Examples as compared with those of Examples. Even with the same component composition, the high ductility at room temperature is inhibited because the average grain size is larger than 20 μm. Further, as the deformation speed increases, the m value and the value of stress reduction degree tend to decrease. Accordingly, in Comparative Examples, even if the strain rate is $1\times10^{-4}$ $s^{-1}$ or $1\times10^{-3}$ $s^{-1}$, a large m value and a large stress reduction degree were not obtained, therefore, a test with a high tensile rate and a strain rate of $1\times10^{-2}$ $s^{-1}$ was not conducted. The small elongation-to-failure and stress reduction degree were confirmed also in the Mg-4.55 mass % Bi alloy (Comparative Example 2) and the Mg-7.80 mass % Bi alloy (Comparative Example 3), each of which have a coarse average grain size of 20 μm. From the above, it can be said that in order to obtain the effect of the present invention, it is important that the average grain size is 20 μm or less.

<Test Result 2>

[Compression Test at Room Temperature—Tubular-Type Test Piece]

Figure 1:
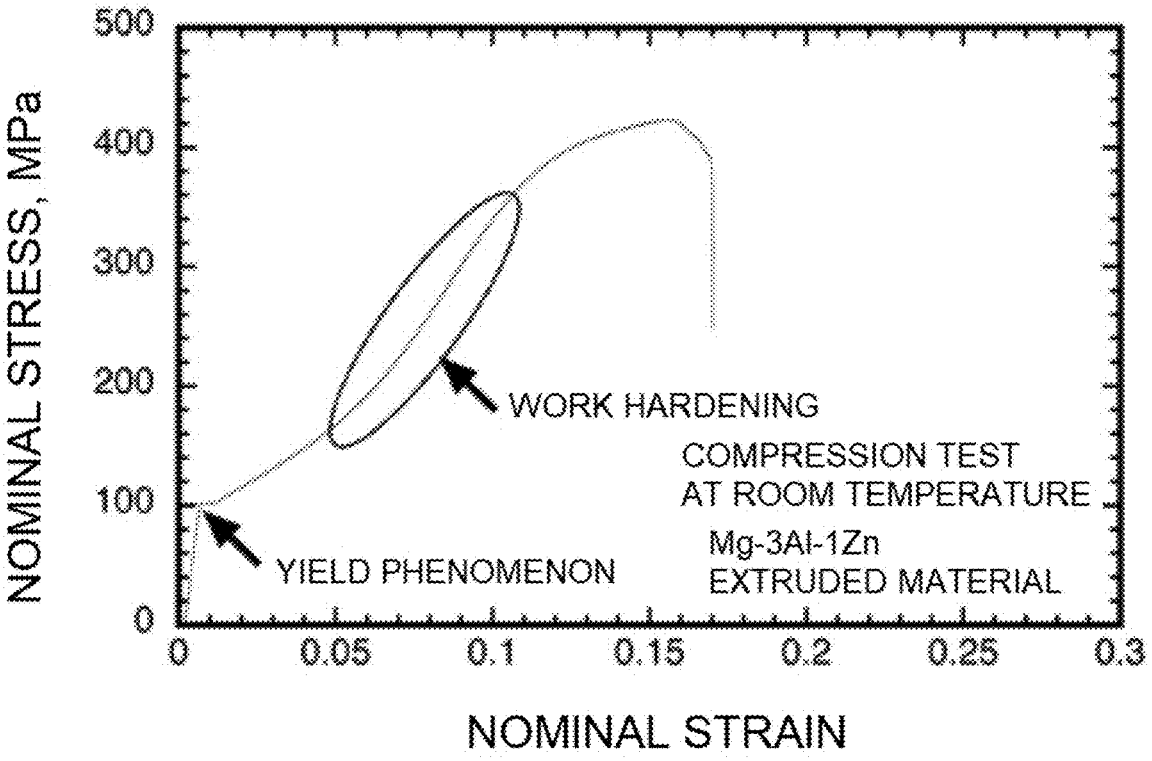
FIG. 1 shows a nominal stress-nominal strain curve obtained by a compression test of an extruded Mg-3 mass % Al-1 mass % Zn alloy at room temperature.
Figure 8:
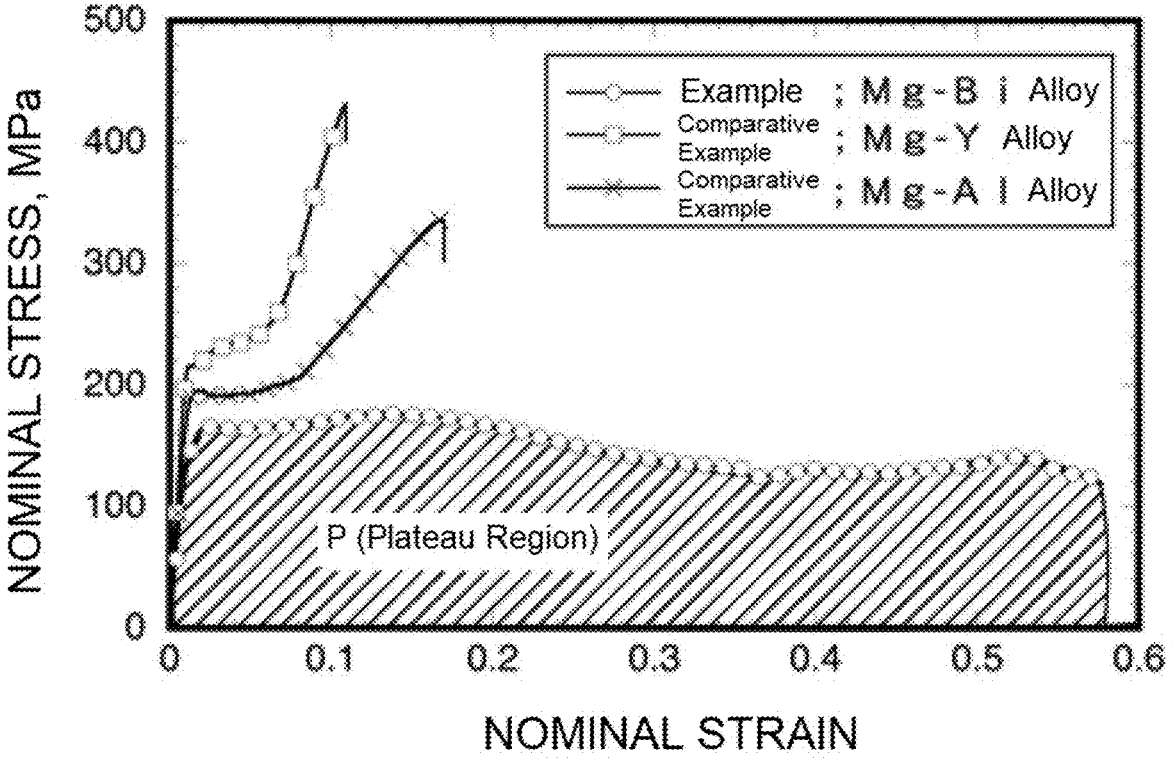
FIG. 8 shows a nominal stress-nominal strain curve obtained by a compression test at room temperature.
Figure 9:
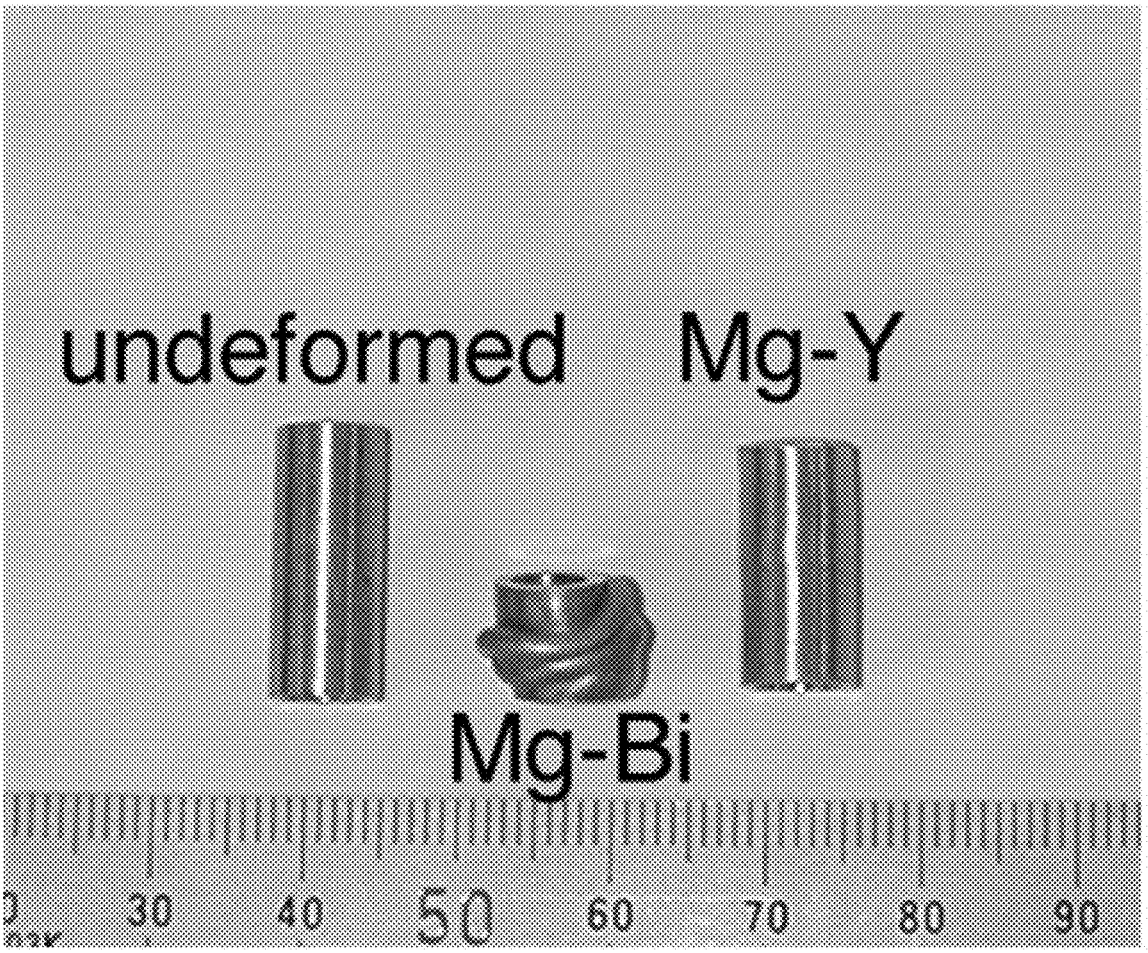
FIG. 9 is a photograph of external view after compression test at room temperature.

By using the Mg-2.5 mass % Bi alloy materials of Example 3 described in Table 2, the forming ability was evaluated by a compression test at room temperature. A tubular-type test piece having a tube wall thickness of 0.8 mm, a length of 17 mm, and an outer tube diameter of 7 mm was used, and the initial compressive strain rate was set to $1\times10^{-3}$ $s^{-1}$. The test piece was collected from an extruded alloy in a direction parallel to the direction of the extruded alloy, and prepared by machining. The obtained nominal stress-nominal strain curve is shown in FIG. 8. it can be understood that the stress-strain curve of the Mg—Bi alloy is different from the aspect of the stress-strain curve of a common Mg-based alloy shown in FIG. 1. As shown in FIG. 8, the Mg—Bi alloy does not exhibit work hardening, when the compressive strain is 0.2 after yielding, and further, even when the compressive strain is 0.5 or more, the stress is kept constant, and it can be confirmed that break has not been generated. This is because twin crystals are not formed during deformation, and grain boundary sliding is responsible for the deformation. Further, it can be understood that the dashed line area (denoted by P in the drawing) in FIG. 8, that is, the plateau region corresponds to the deformability and exhibits excellent deformation properties. In addition, the photograph of external view of the extruded Mg—Bi alloy after deformation is shown in FIG. 9. It can be confirmed that there are no fissures, cracks, or the like on the surface and exhibits bellows deformation.

[Comparison Test]

As a comparative example, by using an extruded Mg-0.34 mass % Al alloy and an extruded Mg-1.1 mass % Y alloy, which have an average grain size (3 μm) almost the same as that of the extruded Mg-2.5 mass % Bi alloy and an additional element concentration of 0.3 mol %, the forming ability was evaluated. The test piece shape and test conditions are the same as those of the above-described extruded Mg-2.5 mass % Bi alloy of Example 3. In FIG. 8, nominal stress-nominal strain curves of the comparative materials are shown. It can be understood that the stress-strain curves of both of the alloys are different from the stress-strain curve of the Mg—Bi alloy, and have the same aspect as that of the common Mg-based alloy shown in FIG. 1. That is, both of the Mg—Y alloy and the Mg—Al alloy exhibit large work hardening when the compressive strain exceeds at least 0.1 with the increase in strain application after yielding. This is because deformed twin is formed after yielding. Although the deformed twin and the parent phase interface have a function of inhibiting the dislocation motion, these stress concentration sites where dislocation has accumulated become the originating points of breakdown and cracks, therefore, it is conceivable to induce the early break. In this regard, the photograph of external view of the extruded Mg—Y alloy after deformation is as shown in FIG. 9, and as compared with the extruded Mg—Bi alloy of Example 3 described above, the deformation amount is poor and the difference in the deformability is clear.

<Test Result 3>

[Compression Test at Room Temperature—Cylindrical-Type Test Piece]

Figure 10:
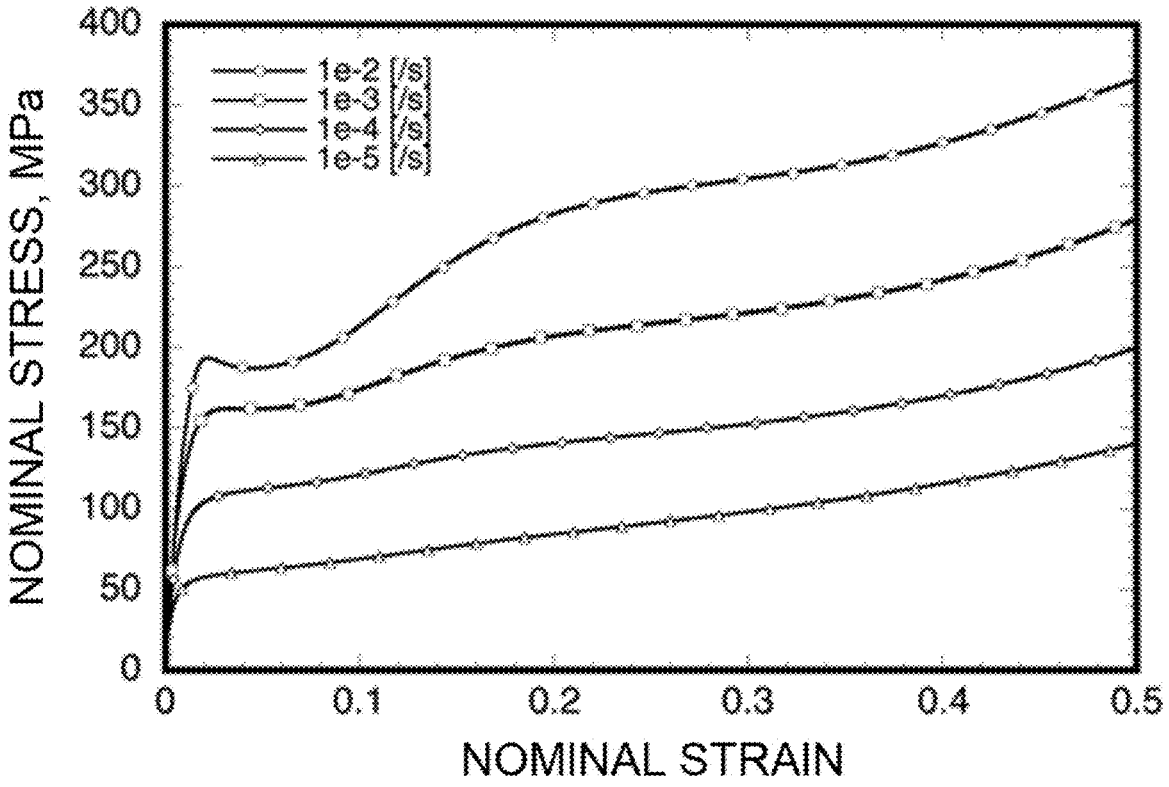
FIG. 10 shows a nominal stress-nominal strain curve obtained by a compression test using a cylindrical test piece of an extruded Mg—Bi alloy of Example 3 at room temperature.

By using the extruded Mg-2.5 mass % Bi alloys of Examples 2 and 3 described in Table 2, a uniaxial compression test was conducted at room temperature. A cylindrical-type test piece having a diameter of 4 mm and a length of 8 mm was used, and the initial compressive strain rate was set within the range of $1\times10^{-2}$ $s^{-1}$ to $1\times10^{-5}$ $s^{-1}$. The test piece was collected from an extruded alloy in a direction parallel to the direction of the extruded alloy, and prepared by machining. The nominal stress-nominal strain curve obtained by a compression test using the extruded Mg-2.5 mass % Bi alloy of Example 3 is shown in FIG. 10. It can be understood that the stress-strain curve of the Mg—Bi alloy is different from the aspect of the stress-strain curve of a common Mg-based alloy shown in FIG. 1. As in the case of the compression test (FIG. 8) using a tubular-type test piece, it can be confirmed that the extruded Mg—Bi alloy did not exhibit work hardening after yielding, and even if the compressive strain was 0.5 or more, a rapid stress reduction did not occur, and the break did not occur. In addition, the deformation stress is greatly affected by the strain rate, and is reduced with the decrease in the strain rate. In the compression test using the a common Mg-based alloy shown in FIG. 1, the deformed twin is responsible for the deformation, therefore, the deformation stress does not depend on the strain rate. Accordingly, in order to examine the deformation mechanism of an extruded Mg—Bi alloy during the compression test, as in the case of the tensile test, the m value between the strain rates is determined by using the nominal stress at a nominal strain of 0.1 as the flow stress. In Table 4, the m values at each strain rate are summarized. As shown in Tables 3 and 4, it can be understood that as in the case of the m value obtained by a tensile test, the m value is 0.1 or more, and the grain boundary sliding is responsible for the deformation also in the compression test. In this regard, by using the extruded Mg—Bi alloys of Examples 5 and 7 described in Table 2, a compression test was conducted, and the obtained m values are also summarized in Table 4. The m values have been 0.1 to 0.2 irrespective of the amount of the Bi to be added, and it can be confirmed that the grain boundary sliding is responsible for the deformation even in the compression test.

added or the average grain size. As a result, it can be understood that the extruded Mg—Bi alloy is not affected by the deformation direction, and the material is capable of being deformed in an isotropic manner in three dimensions. In this regard, when the contribution of grain boundary sliding to the deformation becomes smaller, the value of deformation anisotropy becomes smaller, however, in the present invention, if the value of deformation anisotropy is 0.8 or more, it is determined that the material is capable of being deformed in an isotropic manner in three dimensions. In this regard, it is considered that also for the extruded Mg—Bi alloys of the Examples other than those shown in Table 4, the values of the deformation anisotropy are 0.8 or more from the results of the above tensile tests at room temperature.

<Test Result 4>

[Internal Friction Test]

Figure 11:
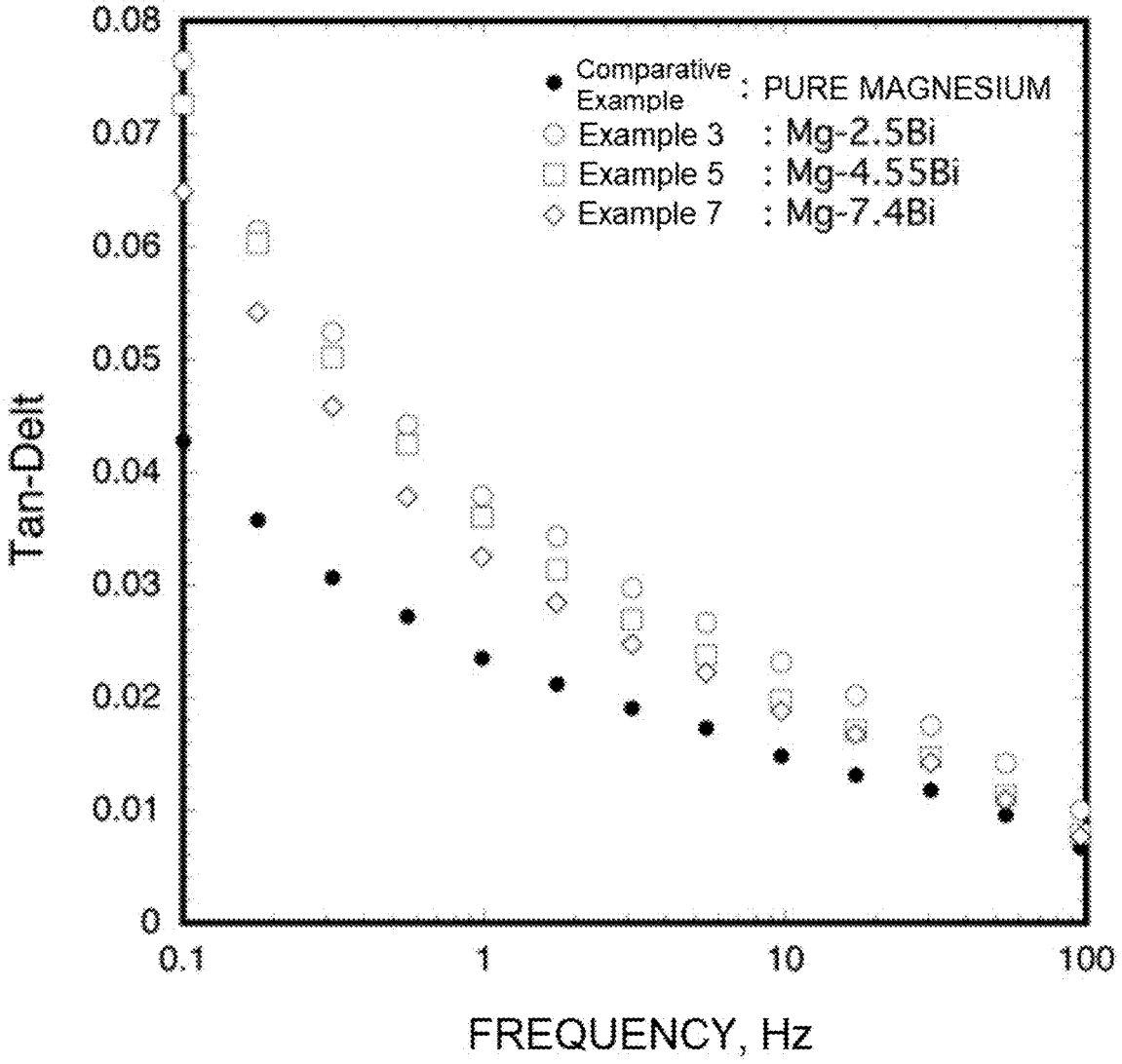
FIG. 11 shows a relationship between the frequency and the tan δ, obtained by an internal friction test.

By using the extruded Mg—Bi alloys of Examples 3, 5 and 7 described in Table 2, the internal friction characteristics were evaluated by a nanoscale dynamic mechanical analysis method installed in a nanoindentation device. The frequency was set within the range of 0.1 to 100 Hz, a surface parallel to the extrusion direction was taken as the measurement surface, and 50 or more points were measured per condition. The obtained relationship between the frequency and the tan δ is shown in FIG. 11. The value of tan δ decreased with the increase of the frequency, and it can be understood that the phenomenons are the same as one another irrespective of the amount of the Bi to be added. In this regard, the larger the value of tan δ is, the more excellent the internal friction characteristics are.

[Comparison Test]

In general, the internal friction characteristics of a pure metal are excellent as compared with those of an alloy of the pure metal in many cases. This is because the interaction

TABLE 4

| | | $1 \times 10^{-2}$, [1/s] | $1 \times 10^{-3}$, [1/s] | $1 \times 10^{-4}$, [1/s] | $1 \times 10^{-5}$, [1/s] | m Value From $1 \times 10^{-2}$ to $1 \times 10^{-3}$ | m Value From $1 \times 10^{-3}$ to $1 \times 10^{-4}$ | m Value From $1 \times 10^{-4}$ to $1 \times 10^{-5}$ |
|---|---|---|---|---|---|---|---|---|
| | | Deformation anisotgoropy | | | | | | |
| Example 2 | Mg—2.5Bi | 1.01 | 1.07 | 1.05 | 1.07 | 0.12 | 0.27 | 0.29 |
| Example 3 | Mg—2.5Bi | 0.95 | 1.10 | 1.10 | 1.04 | 0.1 | 0.17 | 0.25 |
| Example 5 | Mg—4.55Bi | 0.98 | 1.05 | 1.05 | 1.05 | 0.1 | 0.15 | 0.25 |
| Example 7 | Mg—7.8Bi | 0.95 | 1.05 | 1.05 | 1.05 | 0.1 | 0.15 | 0.25 |

$1 \times 10^{-2}$, [1/s]: It means a strain rate of $1 \times 10^{-2}$ [1/s]
$1 \times 10^{-3}$, [1/s]: It means a strain rate of $1 \times 10^{-3}$ [1/s]
$1 \times 10^{-4}$, [1/s]: It means a strain rate of $1 \times 10^{-4}$ [1/s]
$1 \times 10^{-5}$, [1/s]: It means a strain rate of $1 \times 10^{-5}$ [1/s]
Deformation anisotropy: compression flow stress/tensile flow stress Even in the compression test, the grain boundary sliding is responsible for the deformation, therefore, it is suggested that the deformation anisotropy is reduced. In a case of a common Mg-based alloy shown in FIG. 1, in the compression test, the deformed twin having a small deformation stress is responsible for the deformation, therefore, the yield stress differs between the tensile field and the compression field. In general, the compression yield stress is pointed out to be 50% of the tensile yield stress. Accordingly, in order to examine the deformation anisotropy of the extruded Mg—Bi alloy, deformation anisotropy (=compression flow stress/tensile flow stress) at each strain rate was calculated by using the results of the above-described tensile tests. In this regard, each flow stress was set as the value of the nominal stress at the nominal strain of 0.1. These results are shown in Table 4. The values of the deformation anisotropy are 0.9 or more irrespective of the amount of the Bi to be between the additional elements and the dislocation is activated by adding a solute element, and the dislocation motion and the grain boundary sliding, which are essential mechanisms for releasing the internal energy, are suppressed. Accordingly, as a comparative example, by using an extruded pure magnesium having an average grain size (3 μm) almost the same as that of the extruded Mg—Bi alloy, the internal friction characteristics were evaluated. The measuring instrument and measurement conditions were the same as those of the extruded Mg—Bi alloys of Examples 3, 5 and 7 as described above. In FIG. 11, the relationship between the frequency and the tan δ in the pure extruded magnesium of Comparative Example is included. As in the case of the extruded Mg—Bi alloy, it can be confirmed that the internal friction characteristics of the pure extruded magnesium was affected by the frequency, and the values of tan δ decreased with the increase of the frequency. However, in the measurement frequency range, the value of tan δ of the pure extruded magnesium was smaller than that of the extruded Mg—Bi alloy. Such a difference in the values of tan δ is particularly remarkable at lower frequencies. For example, at a frequency of 0.1 Hz, in the pure extruded magnesium of Comparative Example, the value of tan δ was 0.043, but in contrast, in the extruded Mg—Bi alloys of Examples 3, 5 and 7, the values of tan δ were 0.076, 0.073, and 0.065, respectively, and indicated at least 1.5 times or more, as compared with the value of tan δ in the pure extruded magnesium. From these results, also it can be understood that the extruded Mg—Bi alloy of the present invention has more excellent internal friction characteristics than the pure metal has. The excellent internal friction characteristics of the Mg—Bi alloy are due to the activation of the grain boundary sliding.

In addition, in Examples of the present invention, the internal structure was refined by one time of hot plastic working, but in a case where the cross section reduction rate is smaller than the predetermined value, multiple times of hot plastic working may also be performed.

INDUSTRIAL APPLICABILITY

Since the Mg—Bi alloy of the present invention exhibits excellent ductility at room temperature, the Mg—Bi alloy is rich in secondary workability, is easy to be formed into a complicated shape including a plate shape, and further has isotropic deformability in three dimensions due to the deformation mechanism in which generation of deformed twin is suppressed because of the development of grain boundary sliding. In addition, as shown in FIG. 9, any break does not occur, even if large strain is applied, therefore, it can be said that the application as a shock absorbing material or a structural material to an automobile or the like can be achieved. Further, since the grain boundary sliding is developed, the internal friction characteristics are excellent, and application to a part where vibration or noise is a problem can be considered. Of course, various characteristics of improvement of internal friction performance due to grain boundary sliding, reduction of deformation anisotropy, and the like do not change depending on the material shape, therefore, application also to various shapes including a bar, a plate material, a thin material, and a foil material can be achieved. Moreover, any rare earth element is not used as a solute element, therefore, the cost of materials can be reduced as compared with that of a conventional rare earth-added Mg alloy.

REFERENCE SIGNS LIST

σmax: Maximum stress
σbk: Stress at break
BK: Value of nominal strain at which stress decreased by 20% or more
m (Value): Strain rate sensitivity exponent
ED: Direction parallel to the direction of extrusion processing
TD: Direction perpendicular to the direction of extrusion processing
Undeformed: Undeformed sample
G: Grains
P: Plateau region

The invention claimed is:

1. A wrought processed Mg-based alloy having ductility at room temperature, consisting of: 0.42 mass % or more to 7.8 mass % or less of Bi, and a balance of Mg and inevitable components, wherein an average grain size of an Mg parent phase is 0.9 μm or more to 13 μm or less, and in the Mg parent phase in a metal structure of the wrought processed Mg-based alloy, Mg—Bi intermetallic compound particles having a particle diameter of 0.5 μm or less are precipitated while mutually dispersing.

2. The wrought processed Mg-based alloy according to claim 1, wherein a strain rate sensitivity exponent (m value) in a tensile test or a compression test of the wrought processed Mg-based alloy at room temperature shows 0.1 or more.

3. The wrought processed Mg-based alloy according to claim 1, wherein in a stress-strain curve obtained by a compression test of the wrought processed Mg-based alloy at room temperature, work hardening is not exhibited when a compressive strain is 0.2, a plateau region being in a state of constant stress exists, and breaking state is not generated.

4. The wrought processed Mg-based alloy according to claim 1, wherein a value of deformation anisotropy obtained by the tensile test or the compression test of the wrought processed Mg-based alloy at room temperature is 0.8 or more, and wherein the wrought processed Mg-based alloy is capable of being deformed in an isotropic manner in three dimensions.

5. The wrought processed Mg-based alloy according to claim 1, wherein in an internal friction test by a nanoscale dynamic mechanical analysis method, a value of tan δ at a frequency of 0.1 Hz is 1.2 times or more as compared with that of a pure magnesium material.

6. A method for producing the wrought processed Mg-based alloy according to claim 1, wherein an Mg-based alloy casting material passed through steps of melting and casting is subjected to solution treatment at a temperature of 400° C. or more to 650° C. or less for 0.5 hour or more to 48 hours or less, and then subjected to extrusion processing at a temperature of 50° C. or more to 140° C. or less and a cross section reduction rate of 70% or more, wherein after the solution treatment and before the extrusion processing, a billet processed from the Mg-based alloy casting material is held at the extrusion temperature.

* * * * *